US006815627B2

(12) United States Patent
Chen

(10) Patent No.: US 6,815,627 B2
(45) Date of Patent: Nov. 9, 2004

(54) KEYSWITCH STRUCTURE FOR COMPUTER KEYBOARD

(75) Inventor: Wolf Chen, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/271,773

(22) Filed: Oct. 17, 2002

(65) Prior Publication Data

US 2004/0074753 A1 Apr. 22, 2004

(51) Int. Cl.[7] ..... H01H 13/70
(52) U.S. Cl. ..... 200/344; 200/512
(58) Field of Search ..... 200/344, 345, 200/341, 5 A, 517; 400/572, 490–491.2, 495–496

(56) References Cited

U.S. PATENT DOCUMENTS 4,771,146 A * 9/1988 Suzuki et al. ..... 200/344
5,823,325 A * 10/1998 Lin ..... 200/344
6,057,522 A * 5/2000 Chao ..... 200/344
6,100,482 A * 8/2000 Koma et al. ..... 200/344
6,495,782 B1 * 12/2002 Huang ..... 200/341

* cited by examiner

*Primary Examiner*—Ann Mai
*Assistant Examiner*—M. Fishman
(74) *Attorney, Agent, or Firm*—Birch, Stewart, Kolasch & Birch, LLP

(57) ABSTRACT

A keyswitch structure for computer keyboard includes a keycap, a first lever, a second lever, a base and a balance rod. The base has two holes groove lugs and each lug has a rectangular hole. The rectangular hole has an accommodating section on a bottom side thereof. The balance rod has a center rod section and two lateral rod sections vertically extending from two ends of the center rod section. The center rod section is pivotally connected to the connection stage of the keycap and the two lateral rod sections pass through the rectangular holes. The keyswitch structure has reduced gap between the balance rod and the base and thus reduces noise thereof.

6 Claims, 10 Drawing Sheets

KEYSWITCH STRUCTURE FOR COMPUTER KEYBOARD

FIELD OF THE INVENTION

The present invention relates to a keyswitch structure for computer keyboard, especially to a keyswitch structure using metal balance rod for larger keycap.

BACKGROUND OF THE INVENTION

Keyboards are popular input device for people in information processing unit such as computer and apparatus requiring frequent input such as cash register. Therefore, the keyboards are under extensive research to provide better performance such as good tactile feel, movement, sound and balance.

Conventional keyswitches with lever mechanism (scissors type keyswitch) are extensively used in keyboard for notebook computer. However, the keyswitch with larger keycap (such as double cap size or triple cap size) has the problem of tilt key cap because larger size and unbalance force (force not at the center of the keycap). The keyswitch with larger key cap are liable to malfunction or the data cannot be exactly input. To overcome this problem, a resilient metal balance rod is provided between the cap and the base of the keyswitch.

FIGS. 1, 2 and 3 show a conventional keyswitch with a keycap 10*a*, a first lever 11*a*, a second lever 12*a*, a base 13*a* and a balance rod 14*a*, wherein the first lever 11*a* and the second lever 12*a* are cross to each other. The first lever 11*a* has a pivotal shaft 15*a* pivotally connected to a pivotal stage 17*a* on the base 13*a* and the second lever 12*a* has a pivotal shaft 16*a* pivotally connected to a pivotal stage 18*a* on the base 13*a*, respectively. Each of the first lever 11*a* and the second lever 12 has a top end connected to a bottom face of the keycap 10*a*, whereby the first lever 11*a* and the second lever 12 form a lever mechanism.

The first lever 11*a* of the lever mechanism has a bump 19*a* placed at a lower center end thereof and the base 13*a* has a flange 20*a* on top face thereof and corresponding to the bump 19*a*. The bump 19*a* is in contact with and clamped by the flange 20*a* during downward stroke of the keycap 10*a*.

The balance rod 14*a* is a metal rod of U shape and has a center rod section 21*a* pivotally connected to bottom of the keycap 10*a* and two lateral rod sections 22*a*. Each of the lateral rod sections 22*a* is pivotally connected to a rounded holes 24*a* of in a groove 23*a* of the base 13*a*. The rounded holes 24*a* extends along horizontal direction and is higher than a top face of the base 13*a*. The provision of the balance rod 14*a* enables a force exerting on the keycap 10*a* being concentrated at center of the keycap 10*a* such that the keycap 10*a* can be stably moved upward and downward as shown in FIGS. 2 and 3.

A rubber dome 25*a* is placed between the keycap 10*a* and the base 13*a*. When the keycap 10*a* is guided by the lever mechanism for vertical up and down movement, the rubber dome 25*a* below the keycap 10*a* will detach from. or touch a flexible circuit board 26*a* on the base 13*a* and a switch on the flexible circuit board 26*a* is turned off or on.

However, to allow a rotational movement of the balance rod 14*a*, a larger contact allowance is provided for the rounded holes 24*a* through which the lateral rod sections 22*a* passes, as shown in FIG. 2A and FIG. 3A. The larger contact allowance is the source of noise in current keyboard for notebook computer. Moreover, if the lateral rod section 22*a* has larger contact area with the rounded hole 24*a*, noise is also liable to occur.

SUMMARY OF THE INVENTION

It is an object of the present invention to provide a keyswitch structure for keyboard of notebook computer, wherein the keyswitch structure has reduced gap between the balance rod and the base, and reduced noise.

It is another object of the present invention to provide a keyswitch structure for keyboard of notebook computer, wherein the keyswitch has a hook atop a groove thereof to provide more restriction on the stroke thereof.

To achieve above object, the present invention provides a keyswitch structure for keyboard of notebook computer comprising a keycap, a first lever, a second lever, a base and a balance rod. The base has two holed groove lugs. Each lug has a rectangular hole. The rectangular hole has an accommodating section on a bottom side thereof which lowers relative to a top face of the base. The balance rod has a center rod section and two lateral rod sections vertically extending from two ends of the center rod section. The center rod section is pivotally connected to the connection stage of the keycap and the two lateral rod sections pass through and are enclosed by the rectangular holes. The keyswitch structure has a reduced gap between the balance rod and the base and the keyswitch structure has reduced noise.

The various objects and advantages of the present invention will be more readily understood from the following detailed description when read in conjunction with the appended drawings, which are given by way of illustration only, and thus are not limitative of the present invention, and in which:

DETAILED DESCRIPTION OF THE INVENTION

Figure 1:
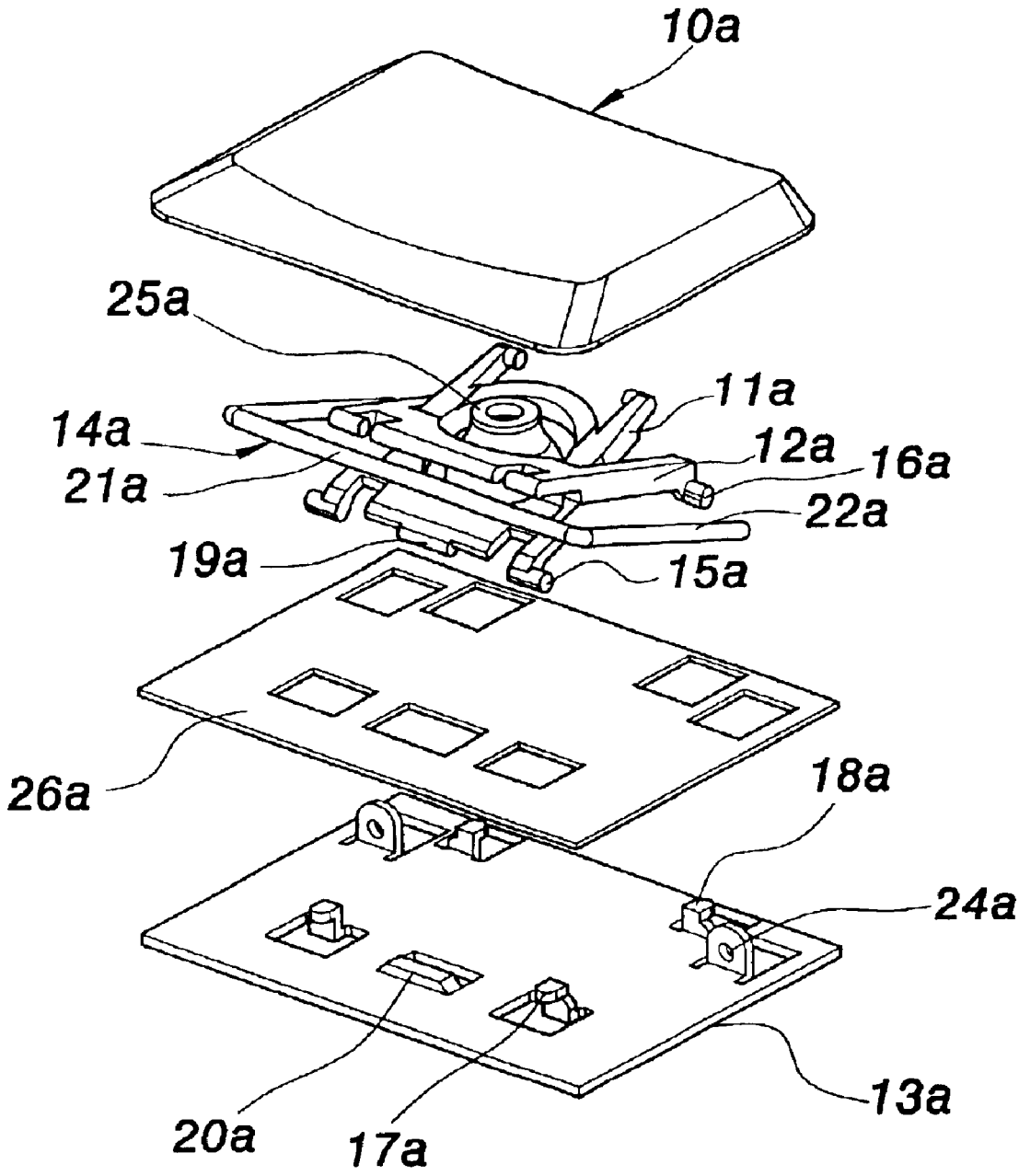
FIG. 1 PRIOR ART
FIG. 1 shows an exploded view of a conventional keyswitch for keyboard of notebook computer.
Figure 2:
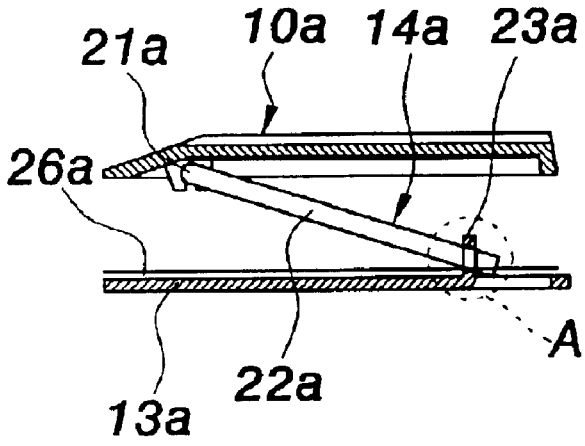
FIG. 2 PRIOR ART
FIG. 2 shows a sectional view of a conventional keyswitch for keyboard of notebook computer with lever mechanism being removed.
Figure 2A:
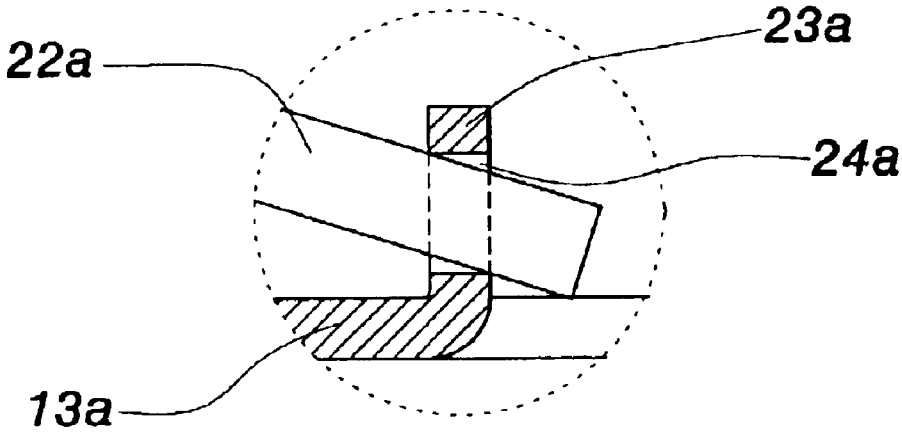
FIG. 2a PRIOR ART
FIG. 2A is an enlarged view of part A in FIG. 2.
Figure 3:
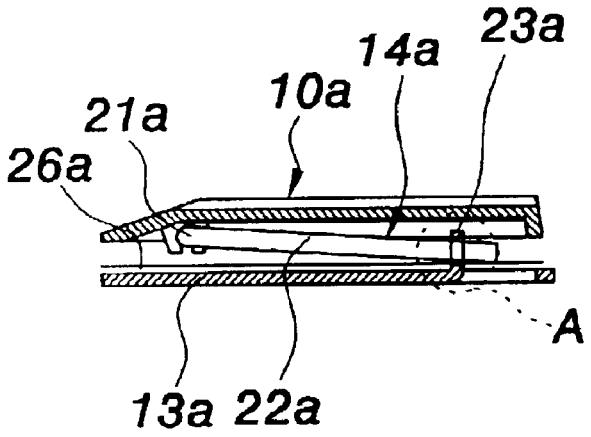
FIG. 3 PRIOR ART
FIG. 3 shows a sectional view of a conventional keyswitch for keyboard of notebook computer in pressed stage and with lever mechanism being removed.
Figure 3A:
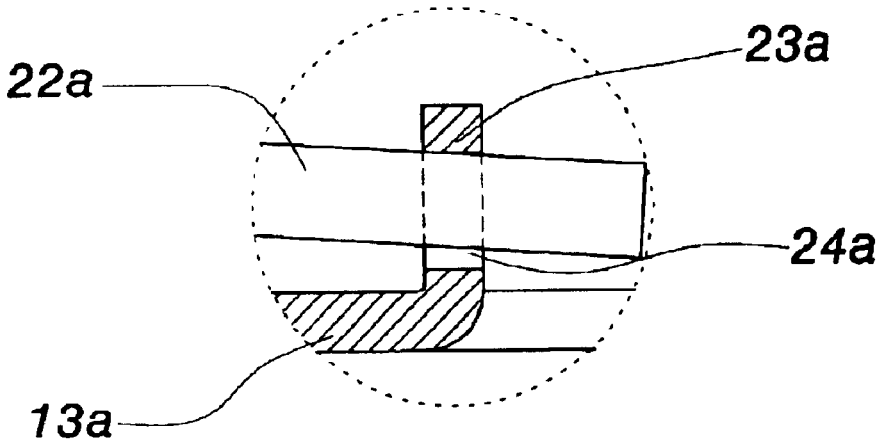
FIG. 3a PRIOR ART
FIG. 3A is an enlarged view of part A in FIG. 3.

With reference to FIGS. 4 to 7, the present invention provides a keyswitch structure for keyboard of notebook computer and the keyswitch comprises a keycap 10, a first lever 20, a second lever 30, a base 40 and a balance rod 50. The keycap 10 is of rectangular shape and having an operative face 11 and an assembling face 12. The assembling face 12 has a connection stage 13 thereon.

The first lever 20 and the second lever 30 are placed between the assembling face 12 of the keycap 10 and the base 40 whereby the first lever 20 and the second lever 30 form a lever mechanism.

The first lever 20 has two first connection shafts 21 on two lateral upper edges thereof and the second lever 30 has two second connection shafts 31 on two lateral upper edges thereof. The first lever 20 and the second lever 30 are assembled to the assembling face 12 by the first connection shafts 21 and the second connection shafts 31, respectively. Therefore, the first lever 20 and the second lever 30 are assembled to the keycap 10 on top ends thereof.

The first lever 20 has two first pivotal shafts 22 on two lateral lower edges thereof and the second lever 30 has two second pivotal shafts 32 on two lateral lower edges thereof. The first lever 20 and the second lever 30 are assembled to the base 40 by the first pivotal shafts 22 and the second pivotal shafts 32, respectively. The first lever 20 has a bump 23 thereon and located at lower center section thereof.

The base 40 is made of metal plate and arranged below the keycap 10, the first lever 20, and the second lever 30. The base 40 has first pivotal stages 41 and second pivotal stages 42 corresponding to the first pivotal shafts 22 and the second pivotal shafts 32. The first pivotal shafts 22 and the second pivotal shafts 32 are pivotally connected to the first pivotal stages 41 and second pivotal stages 42 such that the first lever 20 and the second lever 30 are assembled to the base 40 on lower ends thereof.

Figure 4:
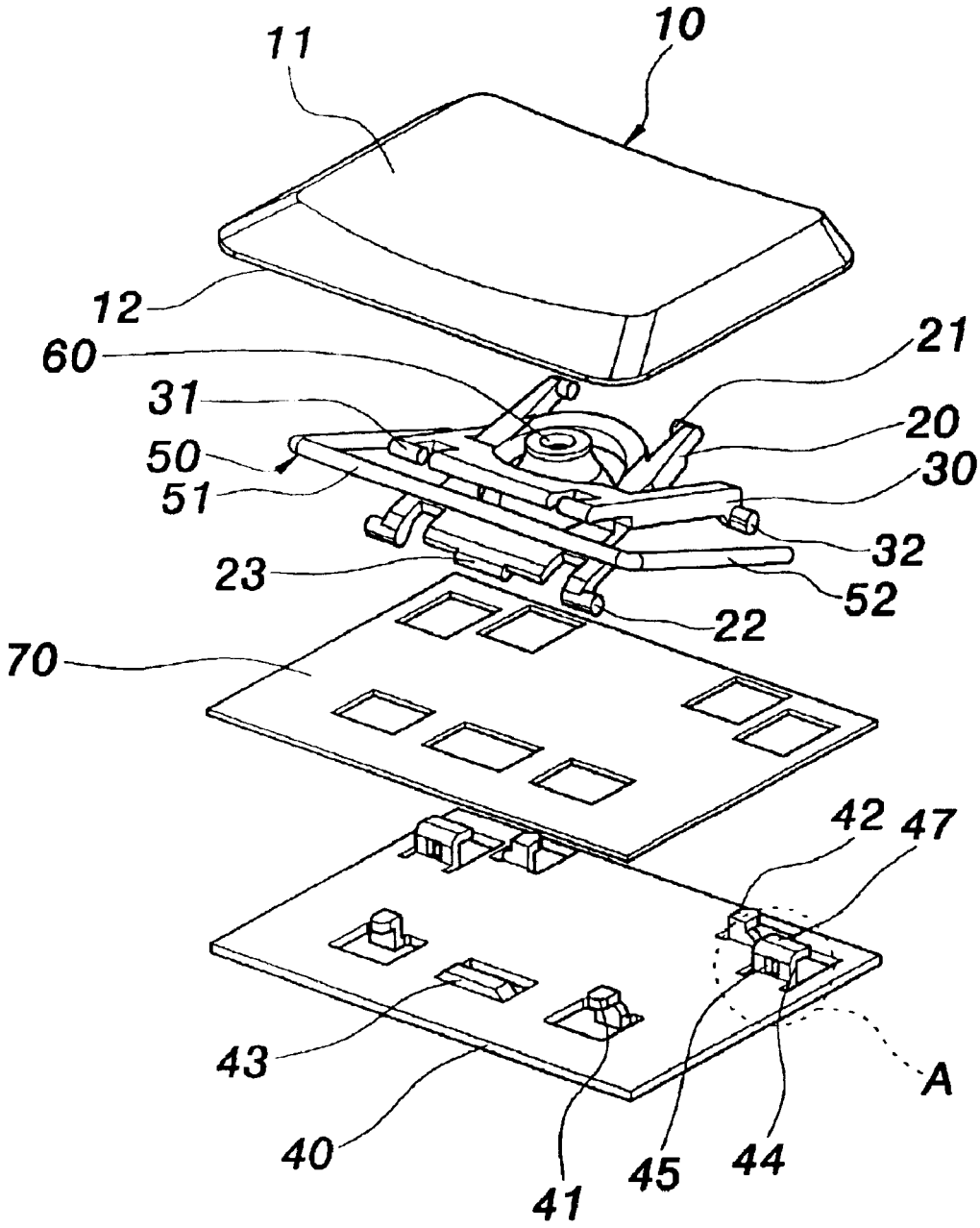
FIG. 4 shows an exploded view of the keyswitch for keyboard of notebook computer according to the present invention.
Figure 4A:
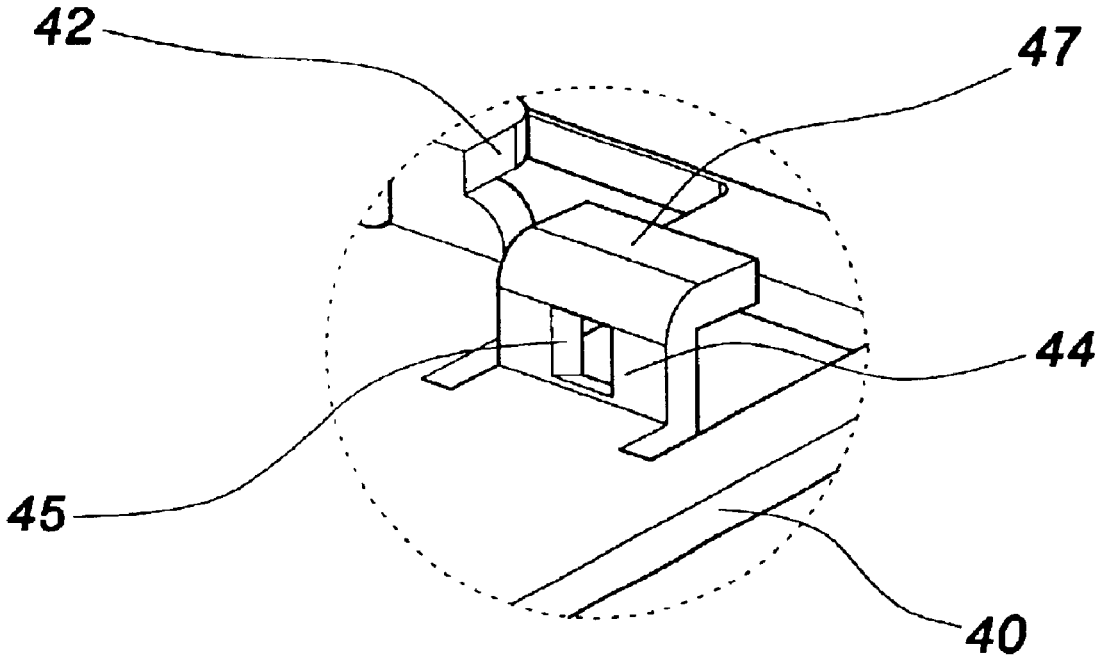
FIG. 4A is an enlarged view of part A in FIG. 4.
Figure 5:
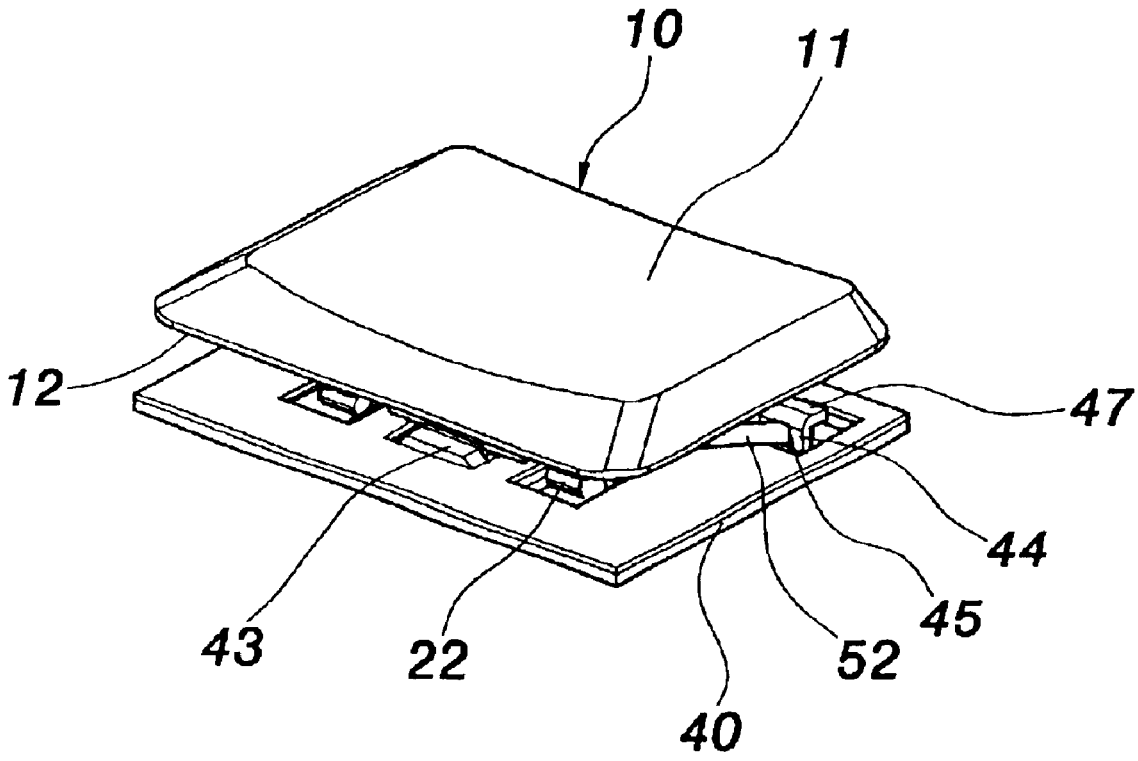
FIG. 5 shows a perspective view of the keyswitch for keyboard of notebook computer according to the present invention.
Figure 6:
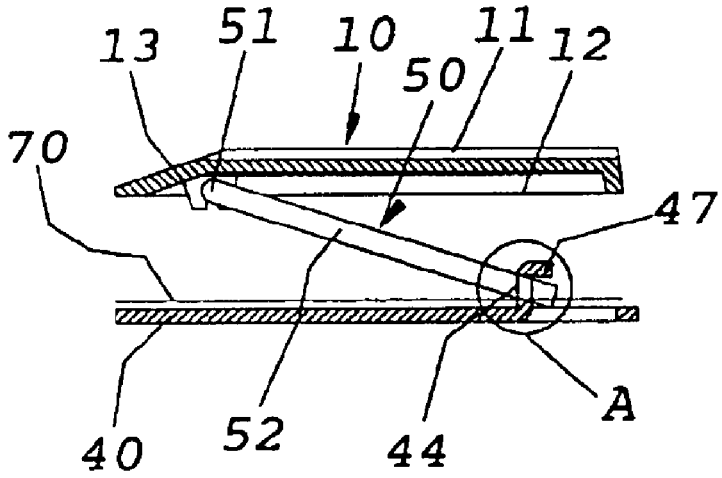
FIG. 6 shows a sectional view of the keyswitch for keyboard of notebook computer according to the present invention with lever mechanism being removed.
Figure 6A:
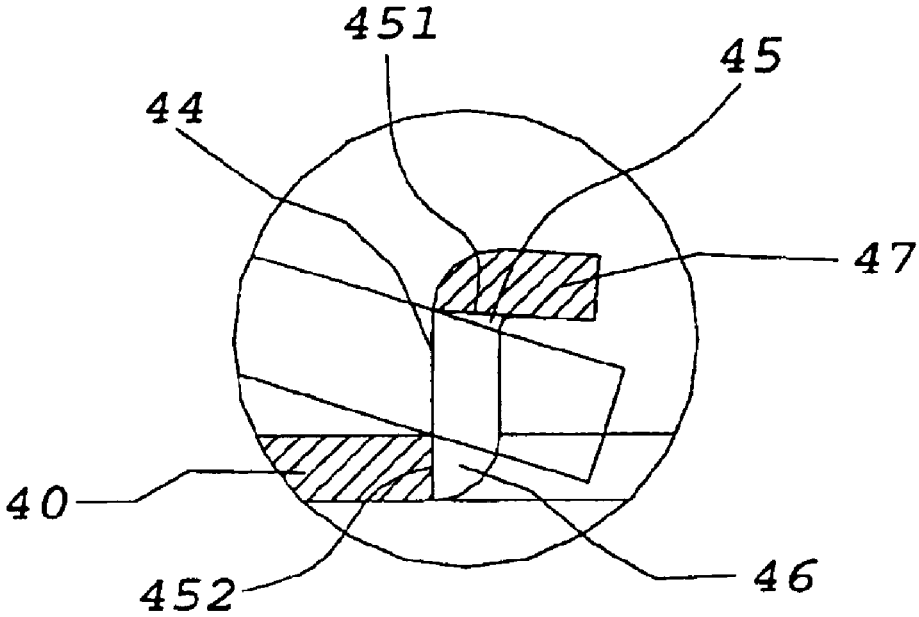
FIG. 6A is an enlarged view of part A in FIG, 6.

The base 40 has a tab 43 corresponding to the bump 23 and the bump 23 is in contact with the tab 43 and clamped by the tab 43 during the downward stroke. The base 40 has two holed groove lugs 44 as shown in FIG, 4A. The holed groove lugs 44 are formed atop the base 40, and each of the lugs 44 has a rectangular hole 45. The hole has an upper edge 451 and a lower edge 452. As seen in FIG. 4A, the front surface of the rectangular hole is larger than the rear surface so that the side walls slant inwardly from front to back. An accommodating section 46 is formed below the rectangular hole 45 as shown in FIG. 6A and FIG. 7A. The accommodating section 46 extends into inner section of the base 40 such that the rectangular hole 45 has asymmetric upper edge and lower edge. The lug 44 has a hook 47 at topside thereof which is parallel to the base 40.

A rubber dome 60 is placed between the keycap 10 and the base 40. When the keycap 10 is guided by the lever mechanism for vertical up and down movement, the rubber dome 60 below the keycap 10 will detach from or touch a flexible circuit board 70 on the base 40 and a switch on the flexible circuit board 70 is turned off or on.

The balance rod 50 is a metal rod of U shape and has a center rod section 51 and two lateral rod sections 52 vertically extending from both ends of the center rod section 51. The center rod section 51 is pivotally connected to the connection stage 13 on the assembling face 12 of the keycap 10. The two lateral rod sections 52 pass through the rectangular holes 45, respectively. The provision of the balance rod 50 enables a force exerting on the keycap 10 being concentrated at center of the keycap 10*a* such that the keycap 10 can be stably moved upward and downward as shown in FIGS. 6 and 7.

Figure 8:
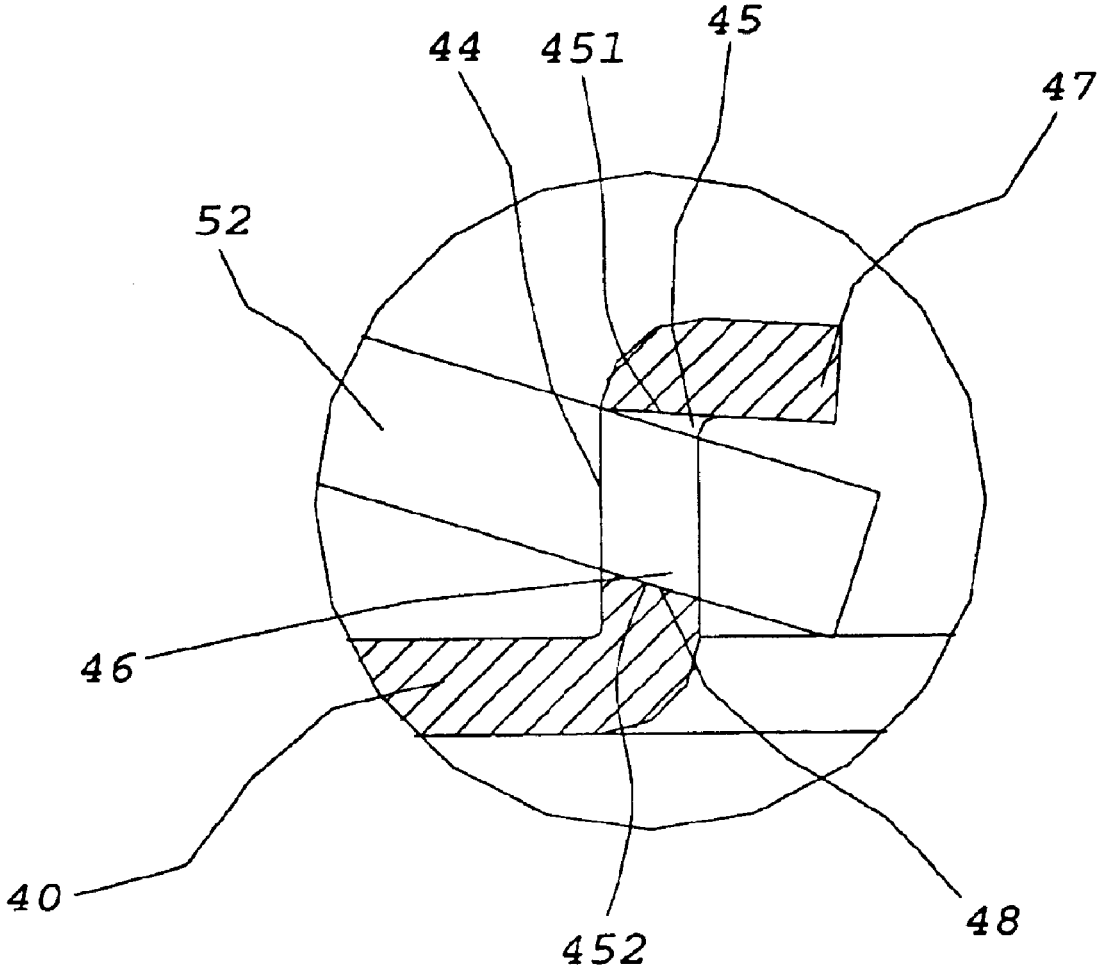
FIG. 8 shows a partially sectional view of the keyswitch for keyboard of notebook computer according to another preferred embodiment of the present invention.
Figure 9:
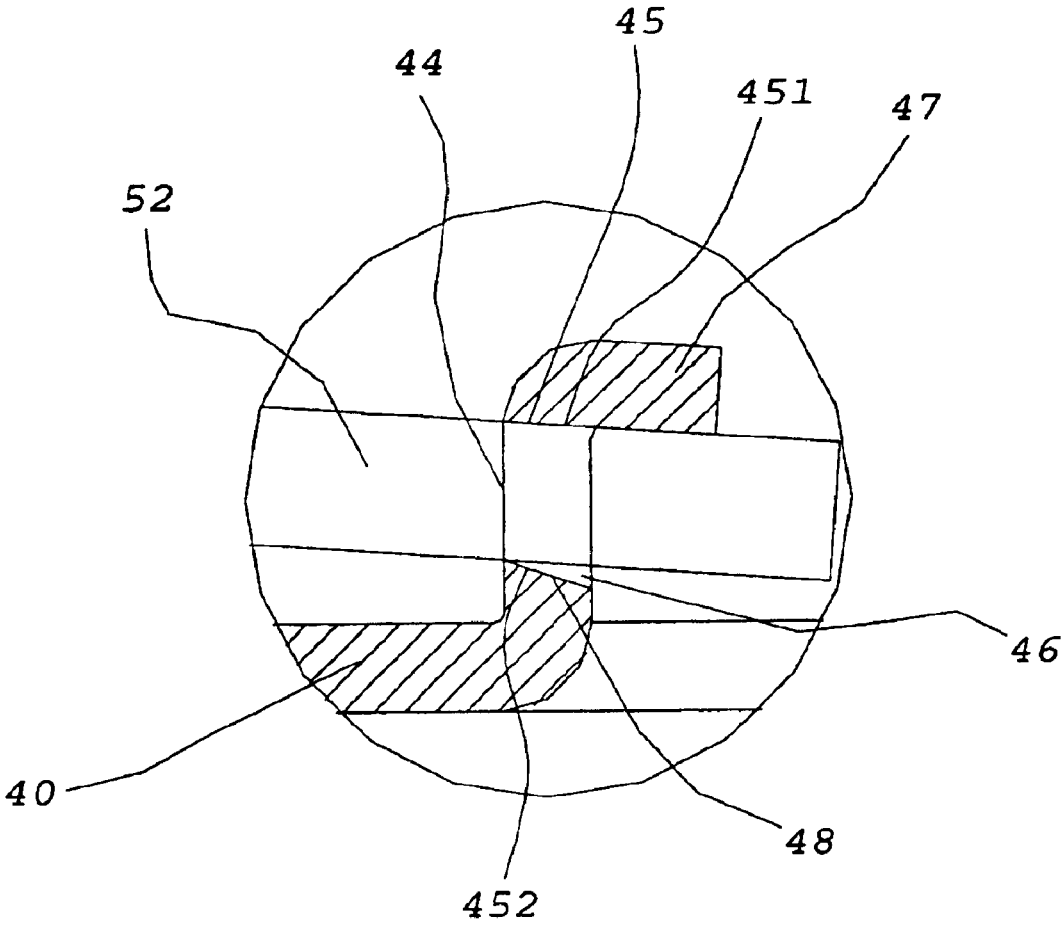
FIG. 9 shows a partially sectional view of the keyswitch for keyboard of notebook computer according to another preferred embodiment of the present invention in pressed state.

As shown in FIGS. 8 and 9, a downward-inclined bevel 48 is formed on bottom side of the rectangular hole 45 such that the accommodating section 46 can receive part of the lateral rod section 52 when the balance rod 50 is rotated upward to an inclined position. Moreover, other parts of the lateral rod section 52 is in contact with the upped edge of the rectangular hole 45 and the top face of the base 40 to prevent excess allowance and noise, as shown in FIGS. 6 and 6A.

Figure 7:
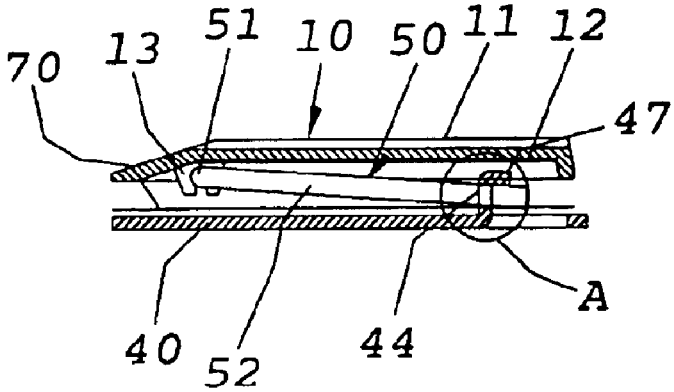
FIG. 7 shows a sectional view of the keyswitch for keyboard of notebook computer according to the present invention in pressed state and with lever mechanism being removed.
Figure 7A:
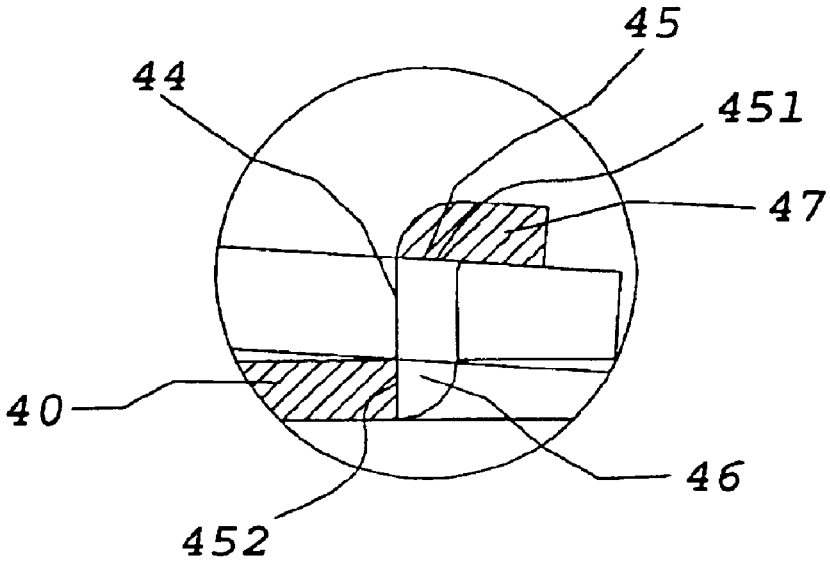
FIG. 7A is an enlarged view of part A in FIG. 7.

Moreover, when the balance rod 50 is rotated downward to a horizontal stage, the lateral rod section 52 leaves the accommodating section 46, while the other parts of the lateral rod section 52 is still in contact with the upped edge of the rectangular hole 45 and the top face of the base 40 to prevent excess allowance and noise, as shown in FIGS. 7 and 7A.

Moreover, the hole 45 has rectangular shape such that the lateral rod section 52 has point contact with the hole 45 to reduce contact area and noise.

Therefore, during the rotation operation of the balance rod 50, the lateral rod section 52 will not have large contact area with the rectangular hole 45 to reduce noise. Moreover, the hook 47 atop the groove 44 can stabilize the operation of the keyswitch.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A keyswitch structure for a computer keyboard, comprising:

a keycap having a connection stage at a bottom face thereof;

a base arranged below the keycap and having two groove lugs, each groove lug having a rectangular hole, the rectangular hole having an accommodating section on a bottom side thereof;

a lever mechanism having a plurality of top ends connected to the keycap and a plurality of bottom ends connected to the base; and a balance rod having a center rod section and two lateral rod sections vertically extending from two ends of the center rod section, the center rod section being pivotally connected to the connection stage of the keycap, the two lateral rod sections passing through and being enclosed by the rectangular holes, said rectangular hole being larger on one surface of said groove lug and smaller on an opposite surface of said groove lug with slanted side walls therebetween so that said balance rod smoothly rotates.

2. The keyswitch structure for a computer keyboard as in claim 1, further comprising a hook atop the groove lug.

3. The keyswitch structure for a computer keyboard as in claim 1, wherein the rectangular hole has an asymmetric upper edge and lower edge.

4. The keyswitch structure for a computer keyboard as in claim 1, wherein the accommodating section extends from a bottom side of the rectangular hole.

5. The keyswitch structure for a computer keyboard as in claim 1, wherein the accommodating section is formed by a bevel downward inclined from a bottom side of the rectangular hole.

6. The keyswitch for a computer keyboard as in claim 1, wherein the lever mechanism comprises a first lever and a second lever in cross arrangement with the first lever.

* * * * *